US011371799B2

(12) United States Patent
Chong et al.

(10) Patent No.: US 11,371,799 B2
(45) Date of Patent: Jun. 28, 2022

(54) DELAYED TRIGGER, PELLET EJECTOR, AND SIMULATED WEAPON

(71) Applicant: AIRSOFT INNOVATIONS INC., Toronto (CA)

(72) Inventors: Carlton Ie Loong Chong, Toronto (CA); Robin Stoddart, Toronto (CA)

(73) Assignee: AIRSOFT INNOVATIONS INC., Toronto (CA)

( * ) Notice: Subject to any disclaimer, the term of this patent is extended or adjusted under 35 U.S.C. 154(b) by 0 days.

(21) Appl. No.: 16/748,528

(22) Filed: Jan. 21, 2020

(65) Prior Publication Data

US 2020/0232750 A1 Jul. 23, 2020

Related U.S. Application Data

(60) Provisional application No. 62/795,289, filed on Jan. 22, 2019.

(51) Int. Cl.
*F41B 11/723* (2013.01)
*F41B 11/73* (2013.01)
*F41B 11/642* (2013.01)

(52) U.S. Cl.
CPC ..... *F41B 11/723* (2013.01); *F41B 11/642* (2013.01); *F41B 11/73* (2013.01)

(58) Field of Classification Search
CPC ..... F41B 11/723; F41B 11/642; F41B 11/73; F41B 11/643; F41B 11/80; F41B 11/89
See application file for complete search history.

(56) References Cited

U.S. PATENT DOCUMENTS 471,176 A * 3/1892 Hubbard ..... F41B 11/647 124/67
487,169 A * 11/1892 Bailey ..... F41B 11/647 124/67
507,470 A * 10/1893 Bailey ..... F41B 11/647 124/67
603,549 A * 5/1898 Monk ..... F41B 11/647 124/67
5,354,225 A * 10/1994 Hix ..... A63H 33/30 102/368
7,784,455 B1 * 8/2010 Chong ..... F41B 11/62 124/73

(Continued)

*Primary Examiner* — Jonathan C Weber
(74) *Attorney, Agent, or Firm* — Perry + Currier Inc.

(57) ABSTRACT

An example simulated weapon includes a delayed trigger and a pellet ejector. The delayed trigger includes a chamber and a piston slidable between armed and triggering positions. A spring biases the piston towards the triggering position. A locking member releasably locks the piston in the armed position. Release of the piston by the locking member causes the spring to move the piston from the armed position to the triggering position. The pellet ejector is coupled to the delay trigger to be triggered by the delay trigger in the triggering position. The pellet ejector includes a pressure chamber to receive a pressurized fluid and a pellet chamber to receive pellets. A valve is disposed between the pressure chamber and the pellet chamber communicates pressure from the pressure chamber to the pellet chamber. A barrel that extends through the pressure chamber is connected to the pellet chamber to eject the pellets.

15 Claims, 12 Drawing Sheets

(56) References Cited

U.S. PATENT DOCUMENTS

| | | | | |
|---|---|---|---|---|
| 8,925,538 | B2 * | 1/2015 | Chong | F41B 11/80<br>124/73 |
| 2010/0199960 | A1 * | 8/2010 | Chong | F42B 27/00<br>124/57 |

* cited by examiner

DELAYED TRIGGER, PELLET EJECTOR, AND SIMULATED WEAPON

CROSS-REFERENCE TO RELATED APPLICATIONS

This application claims the benefit of U.S. provisional patent application Ser. No. 62/795,289, filed Jan. 22, 2019, which is incorporated herein by reference.

BACKGROUND

Simulated weapons, such as airsoft devices, are used for entertainment, training, and other activities. Typically, such devices eject one or more pellets or BBs. Pellets are expected to impact targets, such as the human participants in the activity. However, the impact is usually low enough to not cause injury.

Precise and predictable operation of simulated weapons is important to the success of the activity. Training or entertainment may suffer if, for example, a simulated grenade fails to eject pellets as expected.

DETAILED DESCRIPTION

This disclosure relates to simulated weapons, pellet ejectors, and delayed triggers that provide reliable and configurable operation.

Figure 1:
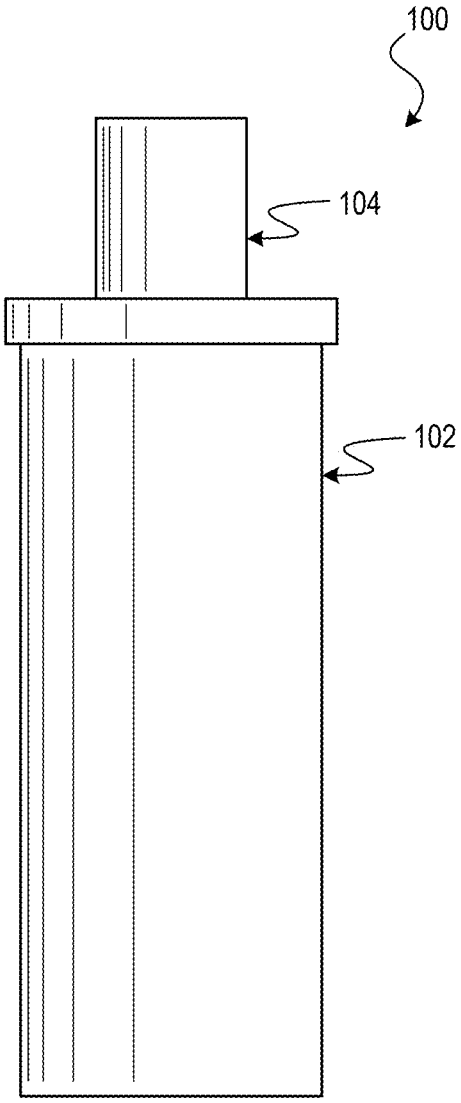
FIG. 1 is a side view of an example simulated weapon.
Figure 12:
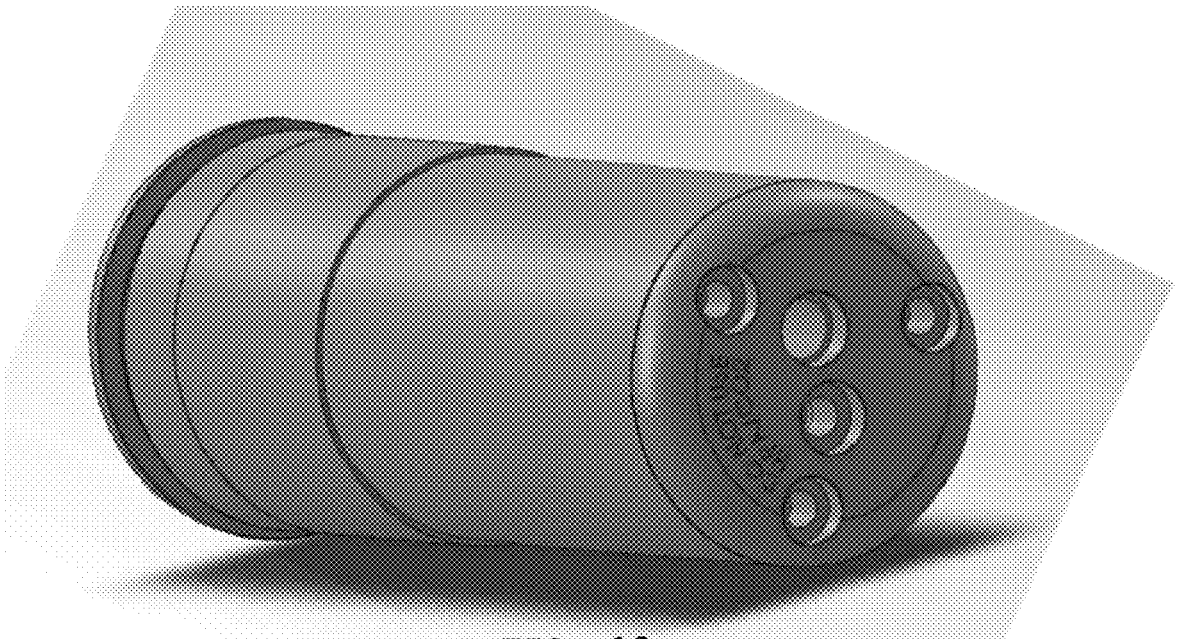
FIG. 12 is a perspective view of an example simulated grenade.

FIG. 1 shows a simulated weapon 100. The simulated weapon 100 may be a simulated hand grenade (FIG. 12) or similar device. The simulated weapon 100 may be an airsoft device.

The simulated weapon 100 includes a pellet ejector 102 and a delayed trigger 104. The simulated weapon 100 may be generally cylindrical in shape.

The pellet ejector 102 may be provided with a pressurized fluid, such as compressed gas (e.g., propane, green gas, carbon dioxide, or similar). The state of the pressurized fluid may be a liquid, gas, or combination of liquid and gas. The pellet ejector 102 may further contain pellets (also known as BBs) to be ejected by the pressurized fluid. An example pellet is spherical with a nominal diameter of about 6-8 mm and has a mass of between about 0.1 g to 1.0 g.

The delayed trigger 104 may be used to trigger release of pellets from the pellet ejector 102 under power of the pressurized fluid. The delayed trigger 104 imposes a delay, so that the simulated weapon 100 may be thrown, dropped, or deposited at a location where pellets are required to be dispersed.

Figure 2:
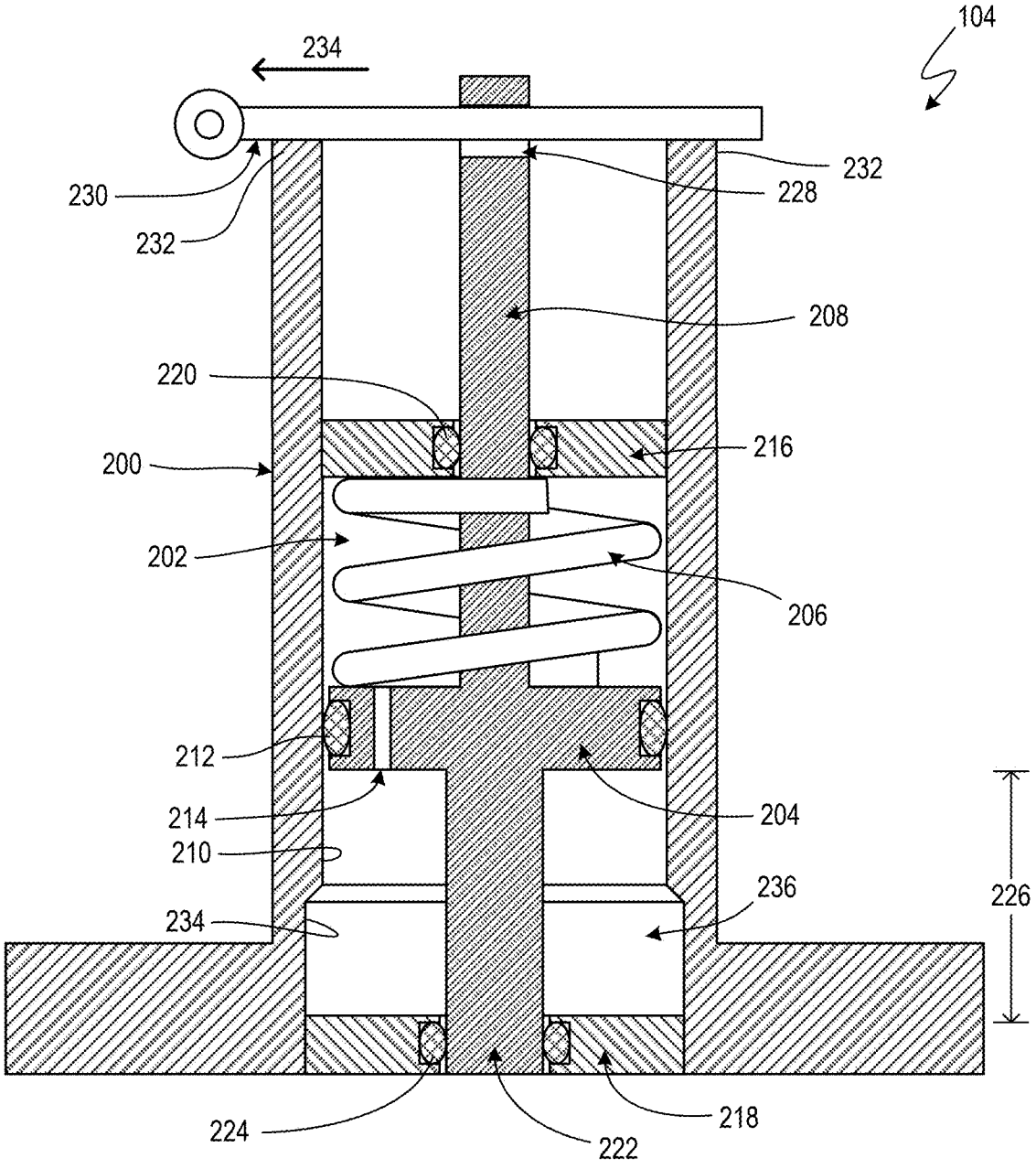
FIG. 2 is a cross-sectional view of an example delayed trigger.

FIG. 2 shows cross-sectional view of an example delayed trigger 104. The delayed trigger 104 may be used with the pellet ejector 102 or a similar device.

The delayed trigger 104 includes a housing 200 that defines an internal chamber 202, a piston 204 slidable within the chamber 202, a spring 206 to bias the piston 204, and a locking member 208 extending from the piston 204 to outside the chamber 202.

The chamber 202 includes an inner wall 210 and is to contain a fluid, such as a viscous oil. The chamber 202 may be cylindrical. That is, the chamber may be define a hollow cylindrical volume generally bounded by a curved wall and two flat end walls. Other shapes are also contemplated.

Figure 3:
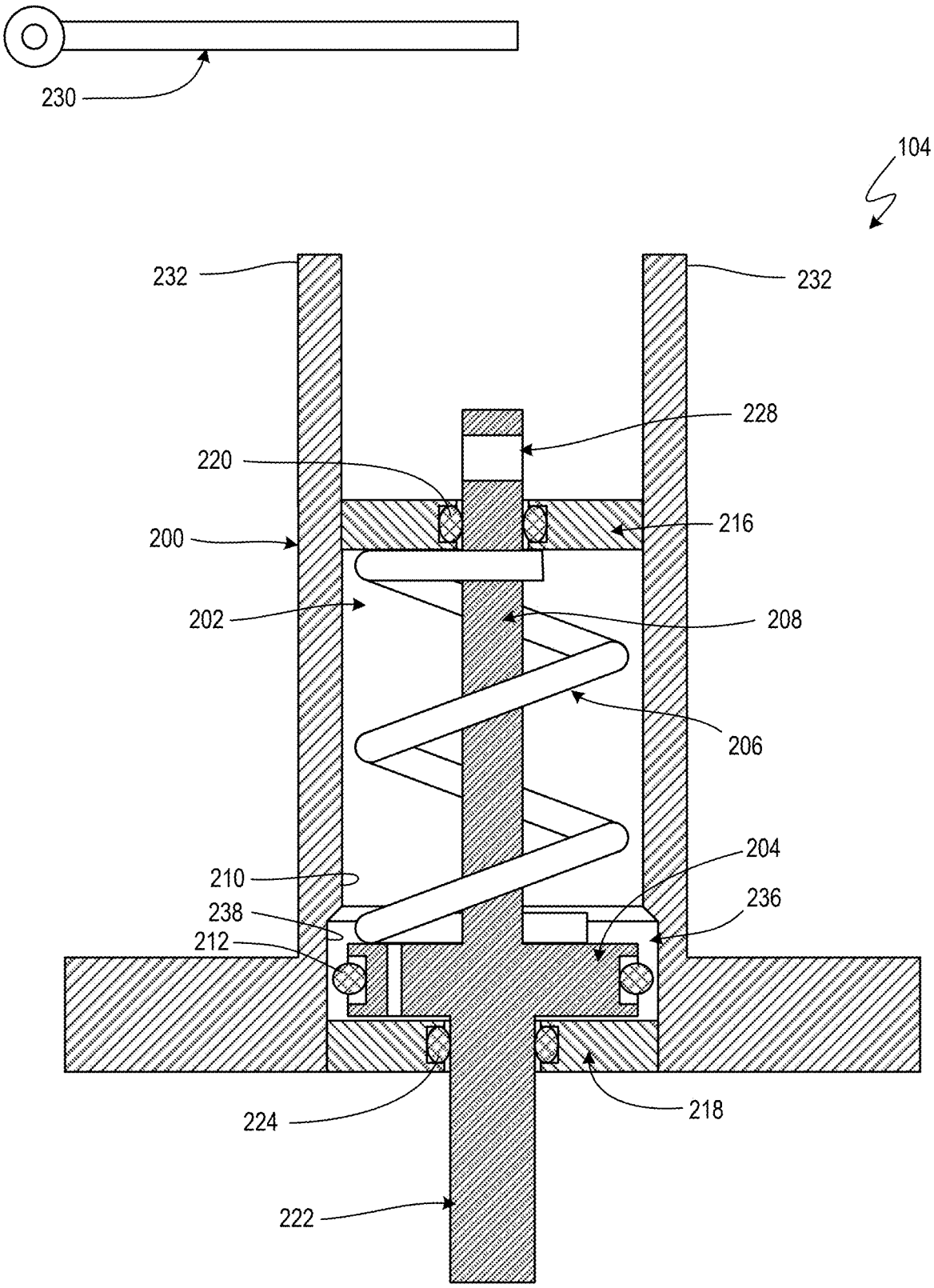
FIG. 3 is a cross-sectional view of the example delayed trigger of FIG. 2 with a pin removed.

The piston 204 is slidably disposed within the chamber 202 between an armed position (FIG. 2) and a triggering position (FIG. 3). The piston 204 may be cylindrical.

The piston 204 includes an outer perimeter that forms a seal with the inner wall 210 of the chamber 202. An O-ring 212 may be used as the seal.

A channel at the piston 204 allows liquid contained by the chamber 202 to pass the piston 204 as the piston 204 slides within the chamber 202. The channel may be provided to the piston 204 or to the chamber 202. For example, the channel may be a through-hole in the piston. In another example, the channel may be a groove or slit on the inner wall 210 of the chamber 202. In still another example, the channel may be a notch at an outside perimeter of the piston 204. In yet another example, the channel may be a break in the O-ring 212. In still another example, the channel may be a combination of any such channels. The channel at the piston 204 provides a restricted flow path for liquid contained by the chamber 202 to pass the piston 204, thereby providing a dampening or slowing effect to the movement of the piston 204.

In this example, the piston 204 includes a channel 214 extending therethrough to provide fluid communication between the two sides of the chamber 202 as divided by the piston 204. The channel 214 allows liquid contained by the chamber 202 to pass the piston 204 as the piston 204 slides within the chamber 202.

The spring 206 biases the piston 204 towards the triggering position (FIG. 3). The spring 206 may be a coil spring. The spring 206 may be captured between the piston 204 and an armed-end wall 216 of the chamber 202 to act as a compression spring to push the piston 204 from the armed position (FIG. 2) towards the triggering position (FIG. 3). In other examples, the spring 206 may be captured between the piston 204 and a triggering-end wall 218 of the chamber 202 to act as a tension spring to pull the piston 204 from the armed position (FIG. 2) towards the triggering position (FIG. 3).

The locking member 208 extends from the piston 204 to releasably lock the piston 204 against biasing of the spring 206 at the armed position. The locking member 208 may be unitary with the piston 204 as, for example, a narrowed end of the piston 304. The locking member 208 may extend out of the chamber 202, for example, through the armed-end wall 216. An O-ring 220 or other seal may be provided at a through-hole in the chamber 202 to accommodate the locking member 208.

Release of the piston 204 by the locking member 208 causes the spring 206 to move the piston 204 from the armed position (FIG. 2) to the triggering position (FIG. 3) to trigger a component coupled to the delay trigger 104, such as the pellet ejector 102 of FIG. 1. Triggering may be effected by a triggering member 222 that extends from the piston 204 through, for example, a through-hole in the triggering-end wall 218 of the chamber 202, which may be sealed by an O-ring 224 or other seal. For example, as shown in FIG. 3, the triggering member 222 may extend from the triggering-end wall 218, as the piston 204 moves towards the triggering position.

Movement of the piston 204 is slowed or dampened by the fluid contained in the chamber 202 having to move from one side of the piston 204 to the other side through the channel 214, thereby causing a delay in triggering.

Various parameters may be selected to control the delay, such as the type/characteristics of fluid used, the spring constant, spring linearity or non-linearity, size of the channel 214 in the piston 204, distance 226 of travel of the piston 204, etc.

The locking member 208 may include an opening 228, such as a through-hole, to receive a pin 230. The housing 200 may include a shoulder 232 to support the pin 230 when engaged with the locking member 208. The pin 230 may engage with the locking member 208 by, for example, being inserted through the opening 228, so as to releasably lock the piston 204 in the armed position. The same or opposing shoulders 232 may provide a support for the pin 230 against the draw of the spring 206. As such, the pin 230 may secure the piston 204 as braced against the shoulder 232.

The pin 230 may be able to be disengaged from the locking member 208 by, for example, being pulled out of the opening 228, so as to release the piston 204 from the armed position. That is, the pin 230 may be slid in the lateral direction of arrow 234 to slide off the shoulder 232 to release the locking member 208, which allows the spring 206 to move the piston 204.

The chamber 202 may further define an acceleration volume 236 at the triggering position of the piston 204. The acceleration volume 236 breaks the seal between the piston 204 and the inner wall 210 to provide additional cross-sectional area for movement of liquid past the piston 204. That is, the liquid is no longer constrained to flow only though the channel 214 in the piston 204. This reduces the resistance to movement of the piston 204 and allows the piston 204 to accelerate towards the triggering position.

In this example, the inner wall 210 is at a first diameter and a second inner wall 238 that defines the acceleration volume 236 is at a second diameter that is larger than the first diameter. As shown in FIG. 3, the O-ring 212 of the piston 204 disengages from the second inner wall 238 when the piston 204 is in the acceleration volume 236.

Due to the acceleration of the piston 204 provided by the acceleration volume 236, the piston 204 may exhibit an impulse or kick during the final portion of its movement into the triggering position. This may improve the effectiveness and reliability in the triggering of the pellet ejector 102 of FIG. 1 or other component.

Figure 4:
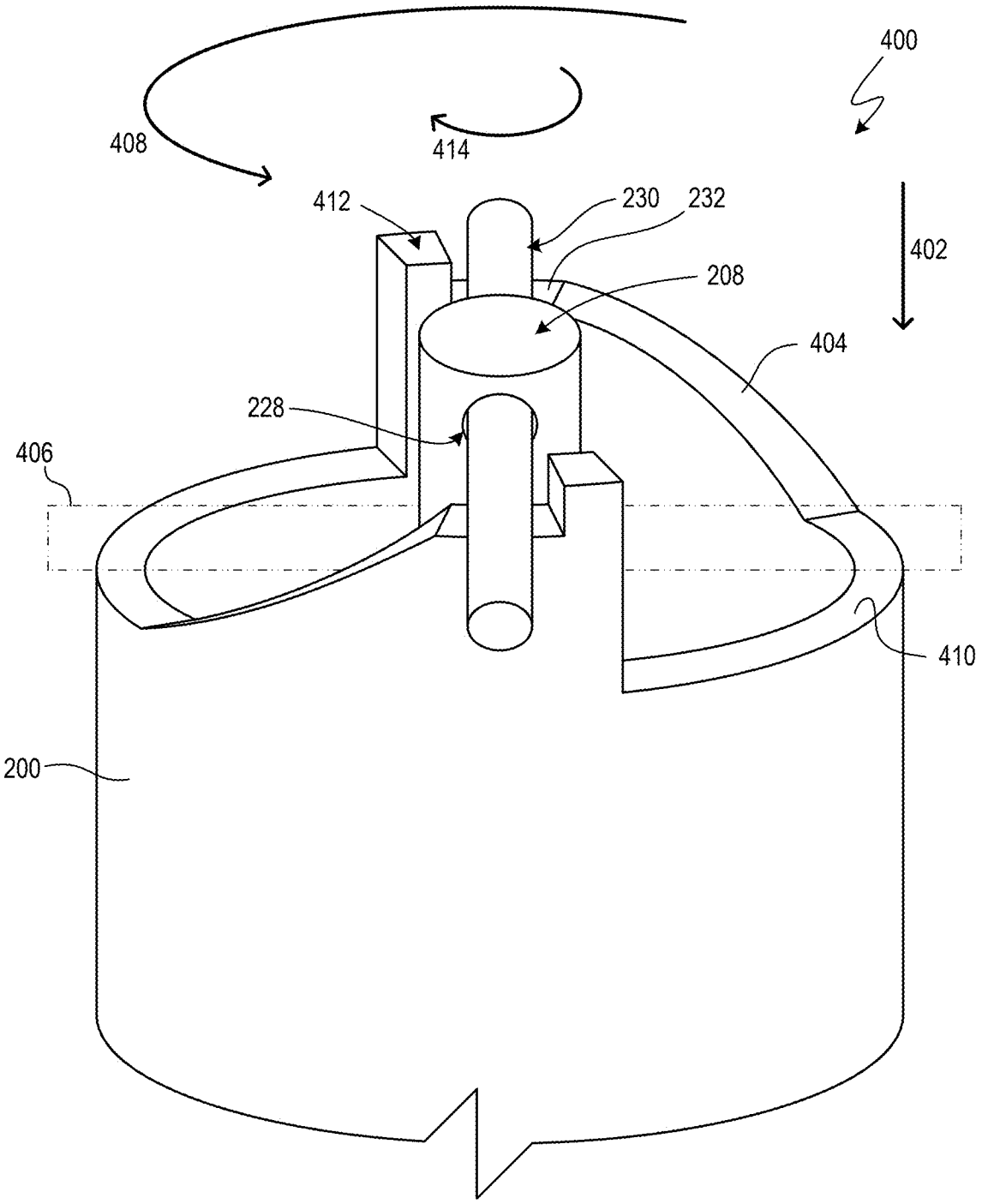
FIG. 4 is a perspective view of a locking mechanism.

FIG. 4 shows a locking mechanism 400. The locking mechanism 400 may be provided to the delayed trigger 104 to return the piston 204 in the armed position after firing and lock the piston 204 in the armed position until the next firing. That is, the locking mechanism 400 may provide the shoulders 232 of FIGS. 2 and 3. For example, the locking mechanism 400 include a generally cylindrical wall, such as a wall formed at an end of a housing 200 that defines the fluid-containing chamber 202.

As mentioned above, a pin 230 is laterally engageable with the locking member 208 via an opening 228, for example. The lateral direction of engagement is lateral with respect to a direction of sliding 402 of the piston 204 in the chamber 202.

The pin 230 may bear against a shoulder 232 to hold the piston 204 in the armed position. Two shoulders 232 at opposite ends of the pin may be provided. In this example, opposing complementary structure is provided with respect to the pin 230, as depicted, and for sake of clarity of explanation one side of such structure is described. If the pin were pulled out of the opening 228 to disengage from the shoulders 232, the piston 204 and locking member 208 would move in the direction 402 towards the triggering position.

The locking mechanism 400 includes a ramp 404 to assist in returning the piston 204 to the armed position illustrated. The pin may be inserted into the opening 228 of the locking member 208, at 406. The pin 230 may then be laterally rotated in a direction 408 to contact the ramp 404 by a user. Lateral rotation of the pin 230 against the ramp 404 pulls the pin opposite the direction 402 to urge the piston 204 towards the armed position against the biasing of the spring 206. Hence, a user inserts the pin 230 and gives it a twist to quickly and easily arm the delayed trigger. The pin 230 then maintains the armed position until pulled.

The ramp 404 may end at a land 410 that provides clearance for the pin 230 to be inserted into the opening 228 of the locking member 208.

A stop 412 may be provided at an end of the shoulder 232 opposite the ramp 404. The stop 412 may include raised material. The stop 412 may block over rotation of the pin 230 by the user.

The piston 204 may be rotatable within the chamber 202 to accommodate for rotation of the locking member 208. Alternatively, the locking member 208 may be rotatably connected to the piston 204.

The spring 206 may have one end affixed with respect to the piston 204 and another end affixed with respect to the chamber 202. The spring 206 may be directly affixed to the piston 204 by, for example, an end of the spring wire being inserted into the blind bore (not shown; see FIGS. 8A and 8B) in the piston 204. The spring 206 may be directly affixed to the armed-end wall 216 of the chamber 202 by, for example, an end of the spring wire being inserted into the blind hole in the armed-end wall 216.

As such, in examples where the locking member 208 is affixed or integral with the piston 204, lateral rotation of the pin 230 against the ramp 404 may develop a torque in the spring 206. The spring 206 may be affixed to the piston 204 and chamber 202 such that the opening 228 clears the ramp 404 when the spring is free of torque, so that the pin 230 may be readily inserted. Twisting the pin 230 to arm the device thereby develops the torque in the spring 206. The torque is maintained in the armed position. Hence, when the pin 230 is pulled, the torque is released to rotate the locking member 208 back to the orientation where the opening 228 clears the ramp 404, as shown by arrow 414 in FIG. 4. This returning torque allows easier and quicker insertion of the pin 230 and arming of the delayed trigger device.

Figure 5:
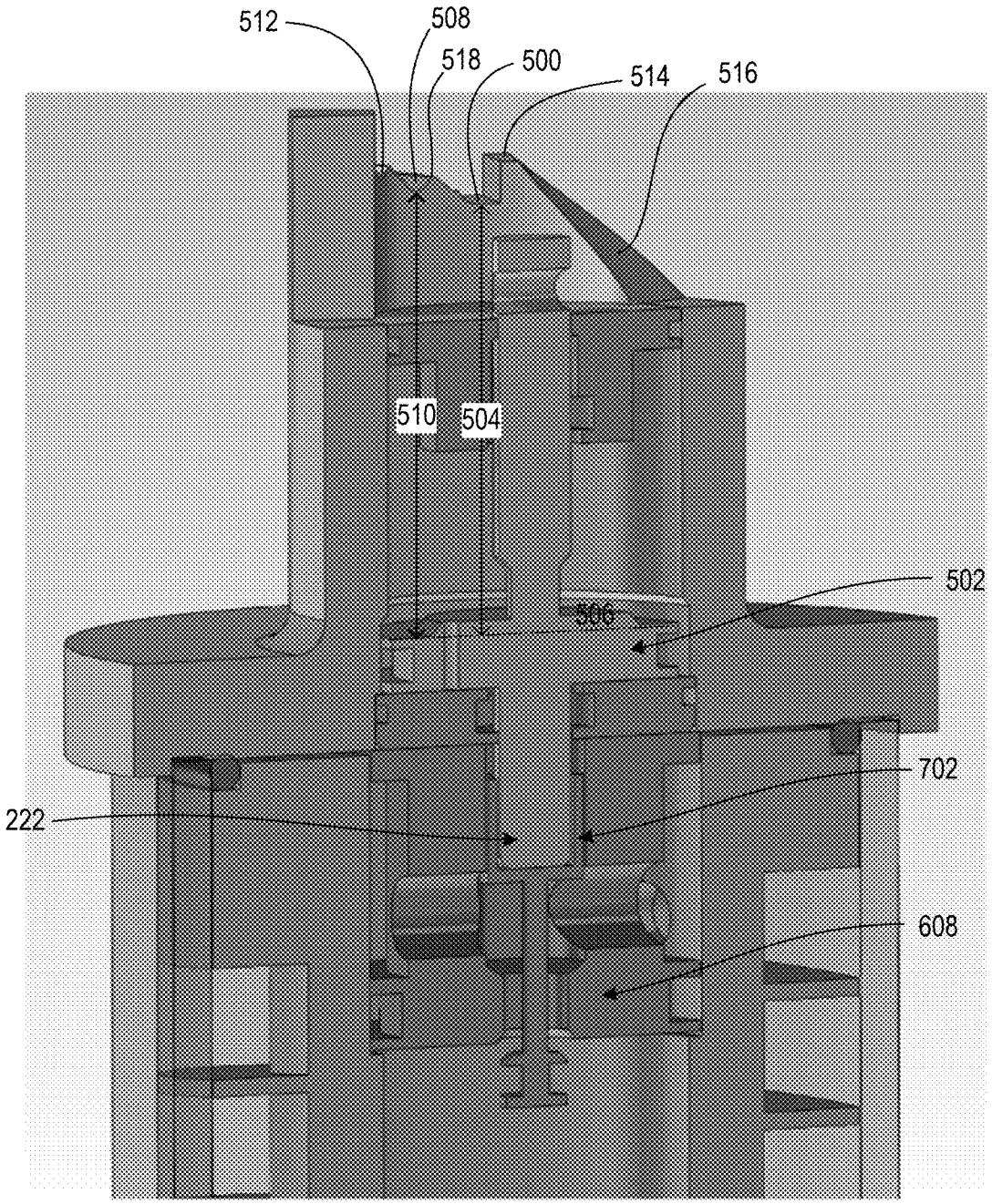
FIG. 5 is a cross-sectional view of an example delayed trigger.

As shown in FIG. 5, multiple different delay settings may be provided.

A first shoulder 500 may support a pin to releasably lock a piston 502 at a first armed position that is a first distance 504 from a triggering position 506.

A second shoulder 508 may support the pin to releasably lock the piston 502 at a second armed position that is a second distance 510 from the triggering position 506. The second distance 510 is greater than the first distance 504 to provide a greater travel distance for the piston 204 and therefore a longer delay.

Any number of shoulders 500, 508, 512 may be provided for any number of discrete delay settings. A specific delay setting may be selected by twisting the pin.

A locking ridge 514 that separates a shoulder 500 from a ramp 516 may be provided to prevent inadvertent triggering. The locking ridge 514 is to hold the pin at the shoulder 500 against a jarring force or an untwisting torque developed in a spring that moves the piston 502. The locking ridge 514 may be defined by the shoulder 500 being lower than the highest part of the ramp 516. A similar ridge 518 may be provided between shoulders 500, 508, 512 to maintain a selected delay setting.

Figure 6:
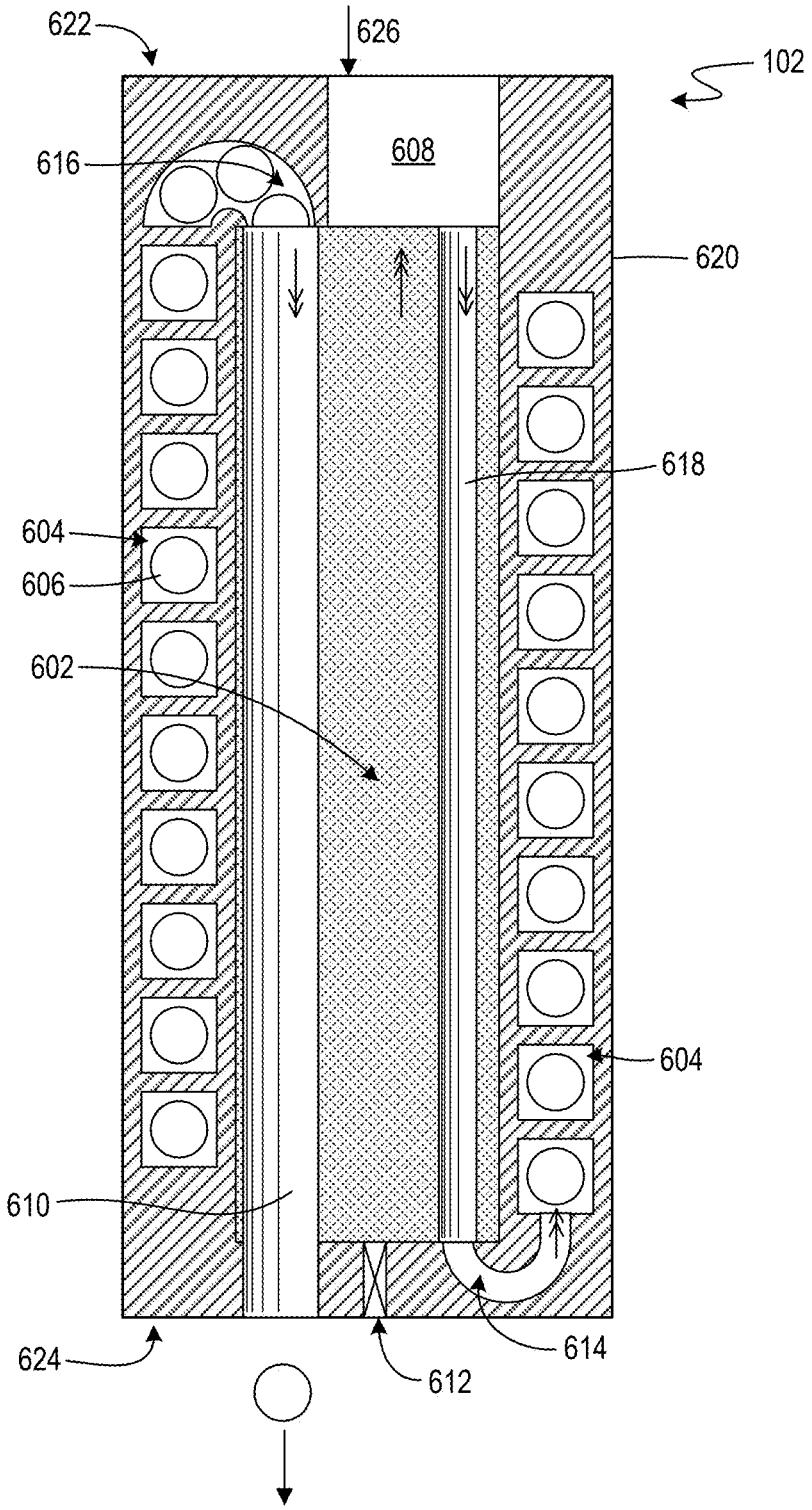
FIG. 6 is a cross-sectional view of an example pellet ejector.

FIG. 6 shows a cross-sectional view of an example pellet ejector 102. The pellet ejector 102 includes pressure chamber 602 to receive a pressurized fluid, a pellet chamber 604 to receive pellets 606, a valve 608, and a barrel 610.

The pressure chamber 602 may be provided with pressurized fluid via a fluid filling port 612 that may include a one-way valve to keep the fluid in the pressure chamber 602.

Figure 13:
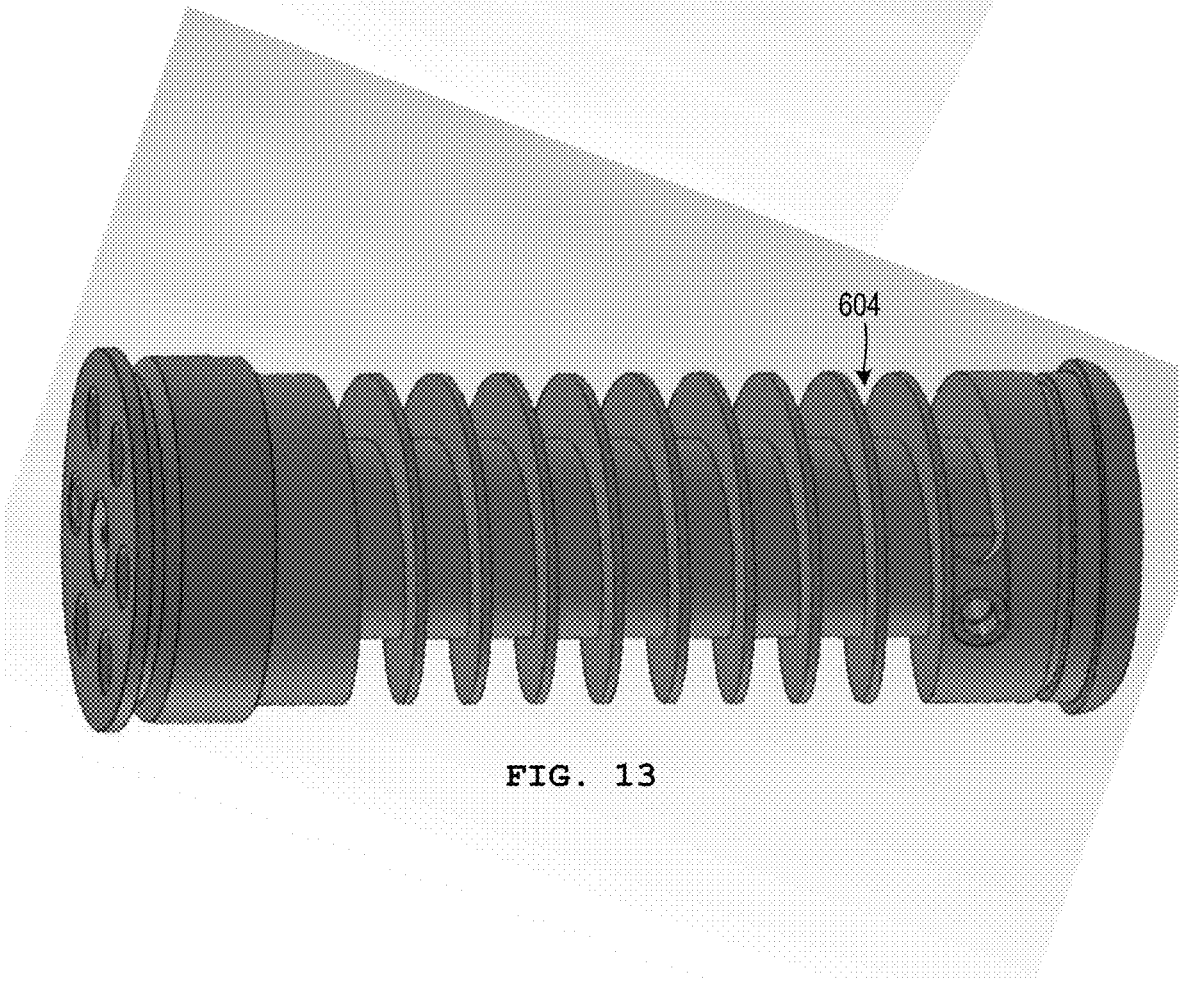
FIG. 13 is a perspective view of an example internal component for a simulated grenade, wherein the internal component defines a pressure chamber at its interior and defines a helical pellet chamber at its exterior.

The pellet chamber 604, in this example, is shaped to contain one row of pellets 606. The pellet chamber 604 may be helical in shape, as shown in FIG. 13, and wrap around the pressure chamber 602. The pellet chamber 604 includes a pressure inlet 614 and a pressure outlet 616. The pressure inlet 614 receives pressurized fluid from the pressure chamber 602 to push the pellets through the pellet chamber 604 towards the pressure outlet 616.

The valve 608 is disposed, from the perspective of fluid flow, between the pressure chamber 602 and the pressure inlet 614 of the pellet chamber 604. The valve 608, when opened, communicates pressure from the pressure chamber 602 to the pellet chamber 604. When closed, the valve 608 stops fluid flow from the pressure chamber 602 to the pellet chamber 604. The valve 608 is shown schematically in FIG. 6 and is shown in greater detail in FIGS. 7 and 9.

The barrel 610 is connected to the pressure outlet 616 of pellet chamber 604 to receive pressurized fluid and pellets 606 from the pellet chamber 604 and to eject the pellets 606. The barrel 610 may include a choke at its muzzle, as will be described in detail with respect to FIG. 10.

The barrel 610 extends through the pressure chamber 602. This saves space and allows the pellet ejector 102 to be compact.

A pressure delivery tube 618 may be provided to connect the valve 608 to the pressure inlet 614 of the pellet chamber 604. The pressure delivery tube may extend through the pressure chamber 602 to further make the pellet ejector 102 more compact.

The overall structure of the pellet ejector 102 may be defined by a housing 620, which may be generally cylindrical. The housing may have a trigger end 622 and an ejection end 624 opposite the trigger end 622. The valve 608 may include an actuating member exposed to outside actuation 626 at the trigger end 622 of the housing, such as actuation provided by a triggering member 222 of a delayed trigger 104. The barrel 610 may exit at the ejection end 624 of the housing 620. The fluid filling port may be located at the ejection end 624 of the housing 620. This arrangement may provide further compactness to the pellet ejector 102.

Flow of pressurized fluid is shown by double-headed arrows. When the valve 608 is opened, flow originates at the pressure chamber 602, passes through the valve 608, passed through the pressure delivery tube 618, enters the pellet chamber 604 at the pressure inlet 614, passes through the pellet chamber 604 carrying pellets 606 with it to the pressure outlet 616, and passes through the barrel 610 carrying pellets 606 with it to eject pellets 606 at the ejection end 624 of the housing 620. It is contemplated that the pressurized fluid may have liquid and gas states within the pressure chamber 602 and may transition to pure gas at any point downstream of the pressure chamber 602.

The pellet ejector 102 may be used with a delayed trigger 104 to form a simulated weapon, such as a simulated hand grenade. The pellet ejector 102 may be used with another trigger, such as a trigger of a simulated grenade launcher that may be affixed to a simulated firearm.

Figure 7:
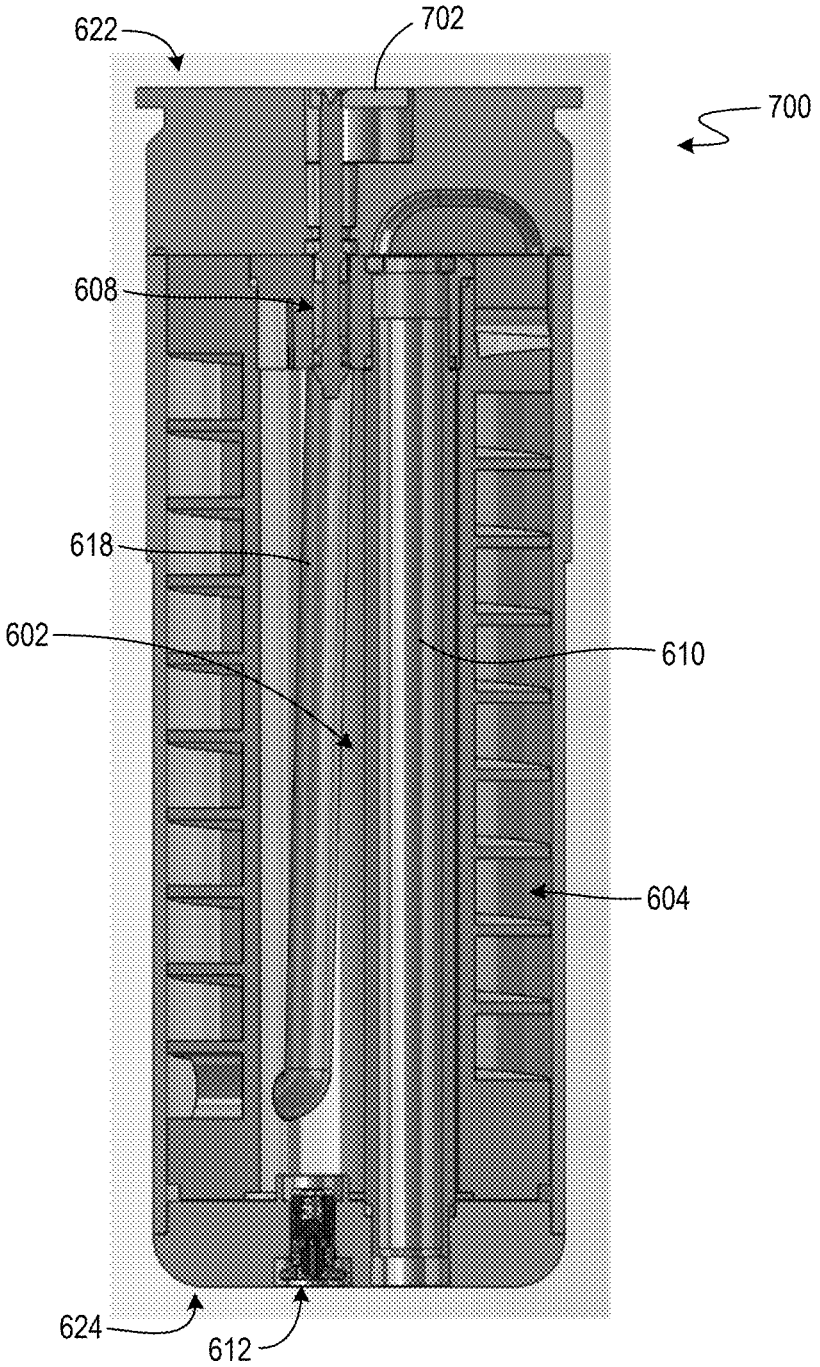
FIG. 7 is a cross-sectional view of another example pellet ejector.

FIG. 7 shows another example pellet ejector 700 that is similar to the pellet ejector 102 and showing additional/different detail. The same numbering is used for clarity. Also shown in FIG. 7 is an actuating member 702 of the valve 608.

Figure 8A:
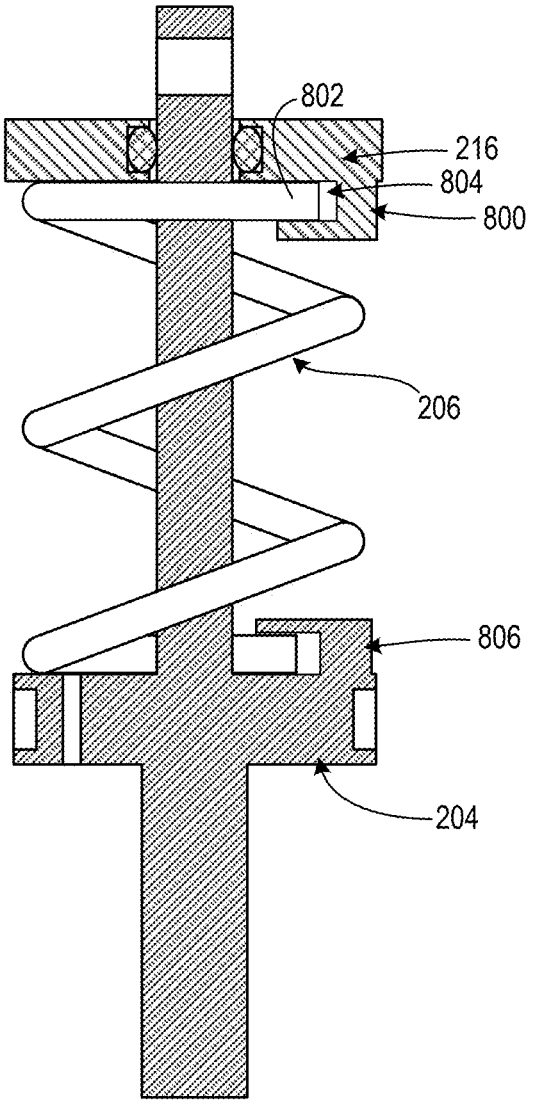
FIG. 8A is a cross-sectional view of an example coupling of a moveable piston to the a stationary armed-end wall.

FIG. 8A shows an example of a way of coupling the moveable piston 204 to the relatively stationary armed-end wall 216 using the coil spring 206, so that the spring 206 may develop a torque when the piston 204 is simultaneously twisted and raised into the armed position. As described above, this allows the spring 206 provide a torsional force, in addition to a linear thrusting force when triggered, so as to return the piston 204 to a starting orientation at the triggering position. The structure illustrated is merely one example of the contemplated coupling.

The armed-end wall 216 may include a coupling structure 800 to secure an end 802 of the wire of the coil spring 206. The coupling structure 800 may include an opening, such as a blind bore 804 that receives the end 802 of the coil spring 206. The end 802 of the spring 206 may be inserted into the bore blind 804. Any type of securement may be used to permanently secure the end 802 of the spring 206 in the bore blind 804, such as a friction fit, interference fit, shrink fit, brazing, cement, adhesive, crimping, etc.

The piston 204 may include a similar coupling structure 806 to permanently secure the other end of the spring 206.

Figure 8B:
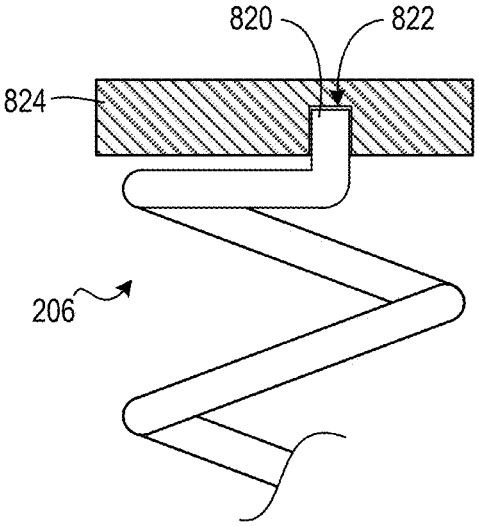
FIG. 8B is a cross-sectional view of another example coupling of a moveable piston to the a stationary armed-end wall.

FIG. 8B shows another example way of coupling the moveable piston 204 to the relatively stationary armed-end wall 216 using the coil spring 206, so that the spring 206 may develop a torque when the piston 204 is simultaneously twisted and raised into the armed position. In this example, the end 820 of the wire of a coil spring 206 is bent to generally align with the expansive/compressive axis of the spring 206. The end 820 may then be inserted into a blind bore 822 or other opening in the moveable piston 204 or armed-end wall 216, designated generally at 824. The permanent securement of the end 820 in the bore 822 may be as above.

Figure 9:
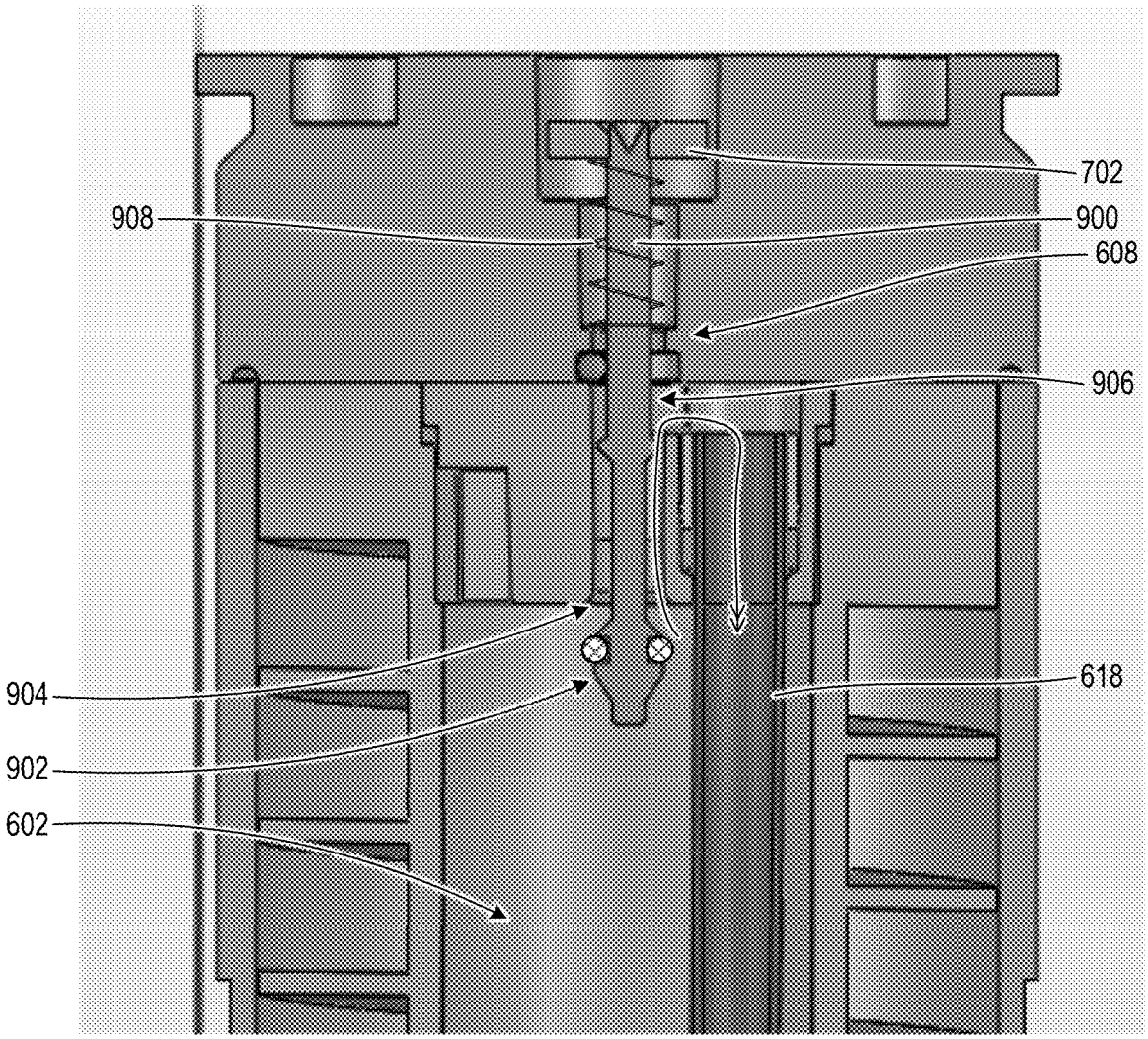
FIG. 9 is a close-up view of a region around a valve that conveys pressure from a pressure chamber to a pressure delivery tube.

FIG. 9 shows a close-up view of the region around the valve 608 that conveys pressure from the pressure chamber 602 to the pressure delivery tube 618. The valve 608 may include a valve stem 900 that extends between an actuating member 702 and a valve head 902. The valve head 902 may include an O-ring or other sealing element to seal closed an inlet port 904 of a connecting channel 906 that communicates the pressure chamber 602 to the pressure delivery tube 618. The valve 608 may be biased to close the inlet port 904 by pressure within the pressure chamber 602. When the valve 608 is opened by, for example, a trigging member 222 of a delayed trigger 104, pressurized fluid flows (double-headed arrow) from the pressure chamber 602, through the valve 608, and into the pressure delivery tube 618 that extends through the pressure chamber 602. A spring 908 may be provided to bias the valve closed. The spring 980 may be a coil spring positioned in a pocket to expand against the actuating member 702.

Figure 10:
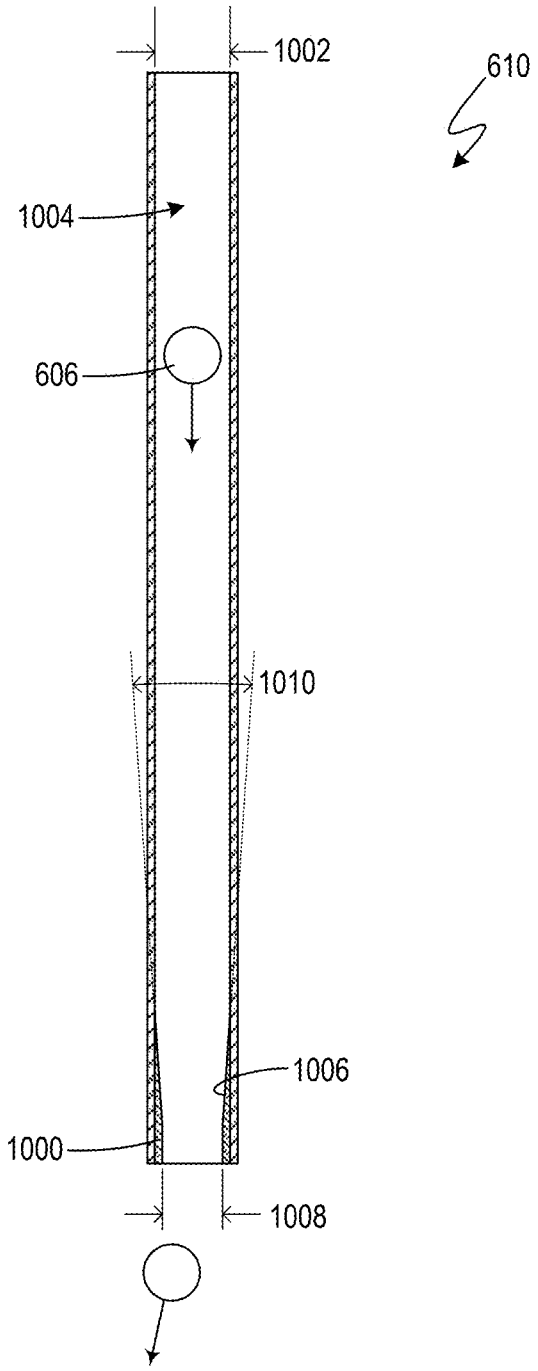
FIG. 10 is a cross-sectional view of an example barrel.

FIG. 10 shows the barrel 610 in isolation. The barrel 610 may a hollow cylinder. The barrel 610 may include a choke 1000 at its muzzle. The choke 1000 may include a linearly narrowing diameter, as depicted, though other geometries are contemplated. The choke 1000 may affect projectile pattern, and the effect may be opposite that a conventional choke of a typical firearm. The choke 1000 may increase dispersion and opposed to reducing dispersion as found in a typical shotgun choke, for example. Increased dispersion is advantageous in a simulated weapon 100 that simulates a grenade or other area-of-effect weapon.

Reduced dispersion may be caused by the size of the pellets 606 relative to barrel diameter. The pellets 606 are larger than what is typically fired from a shotgun. Typical shotgun projectiles are significantly smaller than the barrel (e.g., half diameter or much less typically). The diameter of the pellets 606 may be selected to be much larger, relatively, such as greater than 90% of barrel diameter. A larger projectile is propelled down the barrel and sometimes is deflected by the reduced end of the barrel by varying degrees. Conversely a conventional shotgun fires a bolus of smaller projectiles which is constricted by the choke in order to tailor projectile dispersion. Typically, a slight restriction is used in order to tailor the shape of the bolus of projectiles to reduce its expansion once it has left the barrel.

With the barrel 610 and relative sizing of pellets 606, only one pellet 606 passes through the choke 1000 at a time with its trajectory being affected as it passes through the choke 1000. Significant variation in how subsequent pellets 606 are affected has been observed.

The ratio between the diameter 1002 of the overall bore 1004 of the barrel 610, exit taper 1006 (e.g., angle, linearity) of the restriction of the choke 1000, and outlet diameter 1008 of the restriction may be selected to achieve different degrees of spread and statistical distributions. Moreover, obround openings may be used to cause a wider distribution in a particularly desirable direction (e.g., wider horizontal dispersion, reduced vertical dispersion). In one example, a barrel 610 with a circular cross-section has a substantially straight bore 1004 that terminates at a reduced opening. The diameter 1002 of bore 1004 is not greater than 25% larger than the diameter of a spherical pellet 606. Further, the reduced opening at the choke 1000 has an exit taper 1006 whose included angle 1010 exceeds 10 degrees.

Figure 11A:
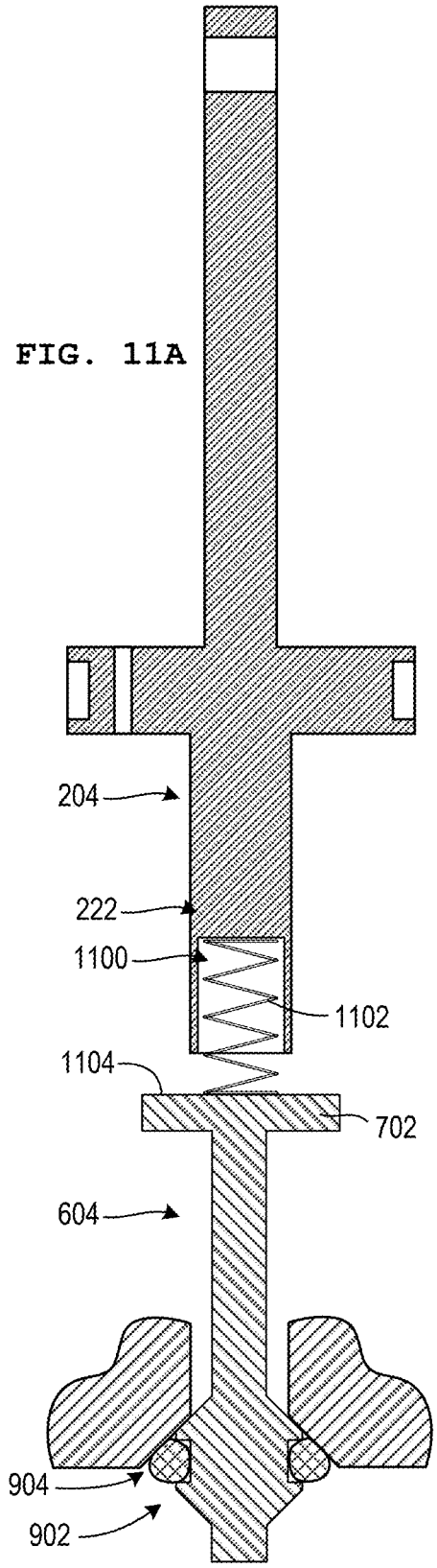
FIG. 11A is a cross-section view of an inlet port sealed by a valve head
Figure 11B:
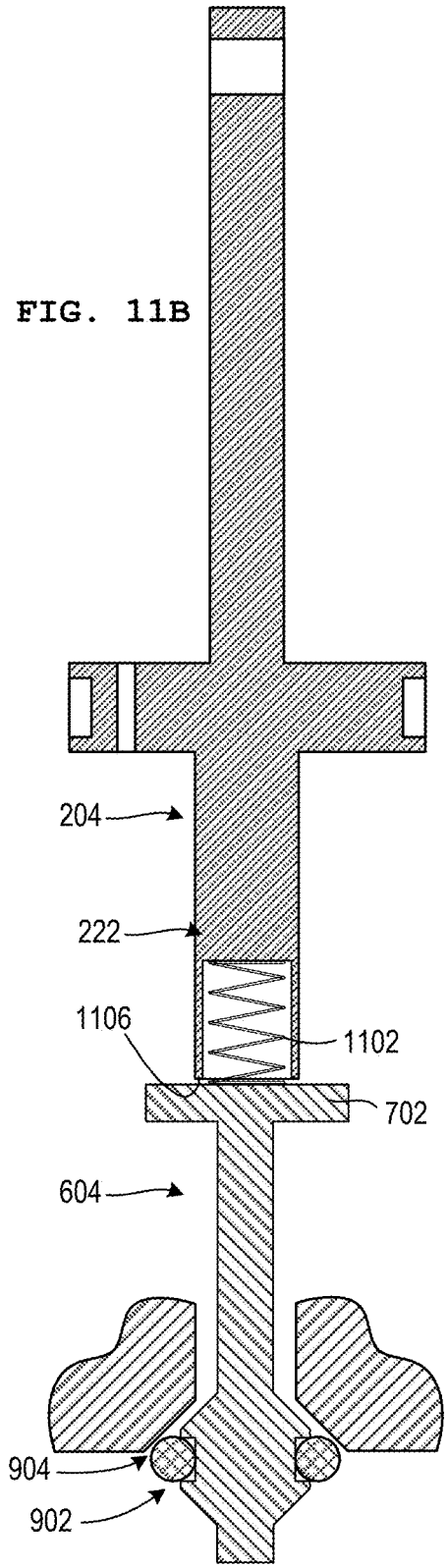
FIG. 11B is a cross-section view of the inlet port of FIG. 11A cracked open to allow flow of pressurized fluid.

FIGS. 11A and 11B show the piston 204 and valve 604 in isolation, with an optional feature to increase the suddenness of the opening of the valve 604. Reducing the time required to open the valve 604, open to the extent that it provides substantial flow of pressurized fluid, may improve the simulated effect of, for example, a grenade. A sudden and rapid burst of pellets may be desired, as opposed to a delayed and/or initially slow ejection of pellets.

The triggering member 222 of the piston 204 may include a blind bore 1100 or similar feature to hold a spring 1102, such as a coil spring or other biasing element. The spring 1102 may be captured between the triggering member 222 (e.g., within its bore) and a surface 1104 of actuating member 702 of the valve 604.

The spring 1102 may provide a pre-load to the valve 604 while the valve 604 remains closed. This pre-load may build as the piston 204 moves towards the triggering position. When the force needed to open the valve 604 is achieved by the spring 1102 and/or by direct contact of the piston's triggering member 222, the energy stored in the spring 1102 may help to push the valve 604 to full open in a quicker manner than by movement of the piston 204 alone.

FIG. 11A shows the inlet port 904 sealed by the valve head 902. The piston 204 has moved towards the trigging position so that the spring 1102 is just about to break the cracking force to open the inlet port 904. Energy is stored in the spring 1102 at this time. FIG. 11B shows the inlet port 904 cracked open to allow flow of pressurized fluid. At this point an end 1106 of the triggering member 222 of the piston 204 may be in direct contact with the surface 1104 of actuating member 702 to directly transmit opening force. Alternatively or additionally, the spring 1102 may be fully compressed (i.e., coils in contact with one another), so as to directly transmit opening force. When the cracking force to open the inlet port 904 is exceeded, the spring 1102 is free to release its built up energy and expand to accelerate the valve 604 towards its full open state. The action of the spring 1102 may reduce the time to open the valve 604 and may compensate for the slower action of the piston 204, which may be relatively slow due to it needing to move though fluid, such as viscous oil.

It should be recognized that features and aspects of the various examples provided above can be combined into further examples that also fall within the scope of the present disclosure. In addition, the figures are not to scale and may have size and shape exaggerated for illustrative purposes.

What is claimed is:

1. A delayed trigger comprising:

a chamber including an inner wall, wherein the chamber is closed against egress of liquid to be contained by the chamber;

a piston slidably disposed within the chamber between an armed position and a triggering position, the piston including an outer perimeter that forms a seal with the inner wall of the chamber, a channel at the piston to allow liquid contained by the chamber to pass the piston as the piston slides within the chamber, wherein the channel provides a restricted flow path for liquid contained by the chamber to dampen or slow movement of the piston;

a spring to bias the piston towards the triggering position; and a locking member extending from the piston to releasably lock the piston against biasing of the spring at the armed position;

wherein release of the piston by the locking member causes the spring to move the piston from the armed position to the triggering position to trigger a component coupled to the delayed trigger.

2. The delayed trigger of claim 1, wherein the chamber defines an acceleration volume at the triggering position, the acceleration volume to break the seal between the piston and the inner wall to provide additional passage of liquid past the piston to accelerate the piston towards the triggering position.

3. The delayed trigger of claim 2, wherein chamber and piston are cylindrical, wherein the inner wall is at a first diameter, and wherein the acceleration volume is defined by a second inner wall of a second diameter that is larger than the first diameter.

4. The delayed trigger of claim 1, further comprising a pin to engage with the locking member to releasably lock the piston in the armed position, wherein the pin is disengageable from the locking member to release the piston from the armed position.

5. The delayed trigger of claim 4, further comprising a shoulder to support the pin when engaged with the locking member.

6. The delayed trigger of claim 5, wherein the shoulder is a first shoulder to releasably lock the piston at the armed position as a first armed position that is a first distance from the triggering position, the delayed trigger further comprising a second shoulder to support the pin when engaged with the locking member, the second shoulder to releasably lock the piston at a second armed position that is a second distance from the triggering position, wherein the second distance is greater than the first distance.

7. The delayed trigger of claim 5, wherein the pin is slidably releasable from the shoulder to disengage from the locking member.

8. The delayed trigger of claim 7, further comprising a ramp to guide the pin towards the shoulder against the biasing of the spring.

9. The delayed trigger of claim 8, wherein the pin is laterally engageable with the locking member with respect to a direction of sliding of the piston in the chamber, wherein the piston and chamber are cylindrical, wherein lateral rotation of the pin against the ramp urges the piston towards the armed position against the biasing of the spring.

10. The delayed trigger of claim 9, wherein the spring is a coil spring including one end affixed with respect to the piston and another end affixed with respect to the chamber, wherein lateral rotation of the pin against the ramp torques the spring.

11. The delayed trigger of claim 10, wherein the locking member includes an opening to laterally engage the pin, wherein the opening clears the ramp to allow insertion of the pin when the piston is in the triggering position.

12. The delayed trigger of claim 11, further comprising a locking ridge separating the shoulder from the ramp, wherein the locking ridge is to hold the pin at the shoulder.

13. The delayed trigger of claim 1, wherein the channel includes a through-hole in the piston.

14. The delayed trigger of claim 1, wherein the channel includes a groove or slit on the inner wall of the chamber, a notch at the outer perimeter of the piston, a break in the seal between the piston and the chamber, a break in an O-ring between the piston and the chamber, or a combination of such.

15. A simulated weapon comprising:

a delayed trigger comprising:

a delay chamber including an inner wall, wherein the delay chamber is closed against egress of liquid to be contained by the delay chamber;

a piston slidably disposed within the delay chamber between an armed position and a triggering position, the piston including an outer perimeter that forms a seal with the inner wall of the delay chamber, a channel at the piston to allow liquid contained by the delay chamber to pass the piston as the piston slides within the delay chamber, wherein the channel provides a restricted flow path for liquid contained by the delay chamber to dampen or slow movement of the piston;

a spring to bias the piston towards the triggering position; and a locking member extending from the piston to releasably lock the piston against biasing of the spring at the armed position;

wherein release of the piston by the locking member causes the spring to move the piston from the armed position to the triggering position; and a pellet ejector coupled to the delayed trigger to be triggered by the delayed trigger in the triggering position, the pellet ejector including:

a pressure chamber to receive a pressurized fluid;

a pellet chamber to receive pellets, the pellet chamber including a pressure inlet and a pressure outlet;

a valve disposed between the pressure chamber and the pressure inlet of the pellet chamber, the valve to communicate pressure from the pressure chamber to the pellet chamber when the valve is opened; and a barrel connected to the pressure outlet of the pellet chamber to eject the pellets;

wherein the barrel extends through the pressure chamber.

* * * * *